US007801316B2

(12) United States Patent
Akino

(10) Patent No.: US 7,801,316 B2
(45) Date of Patent: Sep. 21, 2010

(54) CAPACITOR MICROPHONE

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 1094 days.

(21) Appl. No.: 11/333,279

(22) Filed: Jan. 18, 2006

(65) Prior Publication Data

US 2006/0159294 A1 Jul. 20, 2006

(30) Foreign Application Priority Data

Jan. 19, 2005 (JP) ..... 2005-011283

(51) Int. Cl.

| | |
|---|---|
| ***H04R 25/00*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/174; 381/189; 381/360; 439/607.17

(58) Field of Classification Search ..... 381/174, 381/189, 355, 360, 369; 439/37, 279, 609–610, 439/607.17

See application file for complete search history.

(56) References Cited

U.S. PATENT DOCUMENTS 3,564,416 A * 2/1971 Price ..... 455/95
4,684,762 A * 8/1987 Gladfelter ..... 174/36
5,160,806 A * 11/1992 Harada et al. ..... 174/353
5,767,449 A * 6/1998 Gronowicz, Jr. ..... 174/78
6,463,159 B1 * 10/2002 Ming-Cheng ..... 381/355
6,721,432 B1 * 4/2004 Yamamoto ..... 381/360

FOREIGN PATENT DOCUMENTS

| | | |
|---|---|---|
| JP | 59-081135 | 6/1984 |
| JP | 62-220885 | 9/1987 |
| JP | 3047277 | 1/1998 |
| JP | 11-341583 | 12/1999 |

OTHER PUBLICATIONS

Audio-Technica U.S., AT815b Line + Gradient Condenser Microphone, 2004, Audio-Technica, all pages.*

* cited by examiner

*Primary Examiner*—Curtis Kuntz
*Assistant Examiner*—Jesse A Elbin
(74) *Attorney, Agent, or Firm*—Oblon, Spivak, McClelland, Maier & Neustadt, L.L.P.

(57) ABSTRACT

A capacitor microphone includes a battery holder including a microphone unit housing at one end and a battery holder at the other end, the battery holder being coupled to a connector sleeve; an output connector housed in the connector sleeve, and detachably receiving a grounding sleeve of a microphone cable; a cylindrical conductive battery cover which is movable between a position covering the battery holder and a position releasing the battery holder and is electrically connected to the microphone unit housing at the position covering the battery holder; and an elastic and conductive cloth which is present between the connector sleeve and the battery cover, and is in contact with the connector sleeve and the battery cover, the connector sleeve and the battery cover being electrically connected.

6 Claims, 6 Drawing Sheets

CAPACITOR MICROPHONE

CROSS REFERENCE TO THE RELATED APPLICATION

This application is based upon and claims the benefit of priority from the prior Japanese Patent Application No. 2005-011,283 filed on or around Jan. 19, 2005, the entire contents of which are incorporated herein by reference.

BACKGROUND OF THE INVENTION

1. Field of the Invention

The present invention relates to a capacitor microphone, and more particularly relates to a shield structure of a capacitor microphone including a built-in battery.

2. Description of the Related Art

Generally, a capacitor microphone includes an impedance transformer since a microphone unit suffers from very high impedance. A field effect transistor (FET) is usually used as the impedance transformer, and a vacuum tube is utilized in a rare case.

The capacitor microphone outputs voice signals via a shielded and balanced cable connected thereto. A 3-pin connector (specified in EIJI, RC-5236, "Latch-locked type Round Connector") is used to connect the foregoing components. (Refer to Japanese Patent Laid-Open Publication No. Hei 11-341,583, for example.) With the 3-pin connector, No. 1 pin is for grounding, and No. 2 and No. 3 pins are used as a hot side and a cold side of a signal wire, respectively. XLRM type 3-pin connectors manufactured by Canon Kabushiki Kaisha are available on the market.

Usually, the capacitor microphone is connected to a phantom power source using the balanced and shielded cable, and receives the electric power from the phantom power source. However, a super-directional gun-shaped microphone which is frequently used outdoors includes a size AA battery, and is operated by the electric power from the battery. An example of a capacitor microphone including a built-in battery power source will be described with reference to FIG. 4 to FIG. 6 of the accompanying drawings.

Referring to FIG. 4 to FIG. 6, a cylindrical coupler 11 is provided with a female screw 11*a* and two male screws 11*b* and 11*c* in a rear end. The female screw 11*a* is at the right end of the coupler 11, while the male screws 11*b* and 11*c* are positioned outside the female screw 11*a*. The male screws 11*b* and 11*c* are adjacent to each other. The coupler 11 is inserted form its front end into a microphone unit housing (not shown) with the male screw 11*c* fitted into a female screw of the microphone unit housing. The microphone unit housing houses a capacitor microphone. In order to block electromagnetic waves, the microphone unit housing and the coupler 11 are made of conductive materials such as an aluminum or a brass alloy.

At the rear end of the coupler 11, a male screw 20*a* on an outer front surface of a battery holder 20 is fitted into the female screw 11*a* of the coupler 11. The battery holder 20 has a battery recess 21 in the shape of a ship bottom in order to house a size AA battery, for instance. A positive contact and a negative contact (not shown) are provided at the front and rear ends of the battery recess 21. Necessary wirings are connected to the positive and negative contacts. The battery holder 20 except for the positive and negative contacts is made of a resin material.

A male screw 20*b* is provided around a rear outer end of the battery holder 20, and is fitted into a female screw 30*a* of a cylindrical conductive connector sleeve 30, so that the battery holder 20 and the connector sleeve 30 are coupled. The female screw 30*a* is provided in the front end of the connector sleeve 30. An output connector 40 is fitted into the connector sleeve 30. A setscrew radially passing through the connector sleeve 30 is fitted into the output connector 40, so that the output connector 40 is fixedly attached. A groove 31 extends on an inner peripheral surface of the connector sleeve 30. The output connector 40 is housed in the connector sleeve 30.

A 3-pin connector specified in EIJI RC 5236, "Round Latch type Connector for Acoustic Device" is used as the output connector 40. No. 1 pin, i.e., a grounding pin, is electrically connected to the connector sleeve 30 via a conductive screw (not shown). The output connector 40 is detachably connected to a plug at one end of the balanced and shielded cable (not shown). The plug is provided with a grounding sleeve at a position where the plug is fitted into the connector sleeve 30. The grounding sleeve is connected to a shielded wire of the balanced shielded cable. A locking claw is provided at a part of the grounding sleeve, and is engaged in the groove 31 of the connector sleeve 30 when the grounding sleeve is fitted into the connector sleeve 30. The locking claw is disengaged from the groove 31 by operating a knob. A mechanism for detaching the connector 40 from the balanced shielded cable is well-known, and is not shown.

As shown in FIG. 5 and FIG. 6, a cylindrical battery cover 50 is attached around the output connector 40 and the battery holder 20 by fitting a female screw 51 at the front end of the battery cover 50 into the male screw 11*b* of the coupler 11. The battery cover 50 is long enough to extend around the battery holder 20 and the output connector sleeve 30 when fitted into the coupler 11. The battery cover 50 can be disengaged from the coupler 11, and is moved backwards, so that the battery holder 20 will be detached. In this state, the battery may be exchanged with a fresh battery. Thereafter, the battery cover 50 is again attached and fitted into the coupler 11.

With the capacitor microphone operated by the built-in battery above, the battery holder 20 is adjacent to the output connector 40, and it is not easy to ground the battery cover 50. Therefore, it is very difficult to prevent noises caused by high frequency electromagnetic waves.

The inventor has proposed a capacitor microphone in which a conductive leaf spring comes into contact with a battery cover, and the battery cover is connected to a shield wire of a microphone cord, as disclosed in Japanese Patent Application 2004-209,981.

With the foregoing capacitor microphone, noises caused by electromagnetic waves can be reduced because the battery cover functions as a shield. However, since the leaf spring is in point contact with the battery cover, it is very difficult to block strong electromagnetic waves having high frequencies emitted from cellular phones which are currently very popular. Therefore, noises will be generated if the capacitor microphone is used at close range of cellular phones.

SUMMARY OF THE INVENTION

The invention has been contemplated in order to overcomes the problems of the related art, and aims at providing a capacitor microphone which is devised to improve shielding effects, and is able to block strong electromagnetic waves having high frequencies from a point-blank cellular phone, so that noises can be prevented.

According to one aspect of the invention, there is provided a capacitor microphone includes a battery holder including a microphone unit housing at one end and a battery holder at the other end, the battery holder being coupled to a connector sleeve; an output connector housed in the connector sleeve, and detachably receiving a plug having a grounding sleeve for a microphone cable; a cylindrical conductive battery cover which is movable between a position covering the battery holder and a position releasing the battery holder and is electrically connected to the microphone unit housing at the position covering the battery holder; and an elastic and conductive cloth which is present between the connector sleeve and the battery cover, and is in surface contact with the connector sleeve and the battery cover, the connector sleeve and the battery cover being electrically connected.

BRIEF DESCRIPTION OF THE DRAWINGS

In all Figures, identical parts have identical reference numbers.

DETAILED DESCRIPTION OF THE INVENTION

The invention will be described with reference to an embodiment shown in FIG. 1 to FIG. 3.

Figure 1:
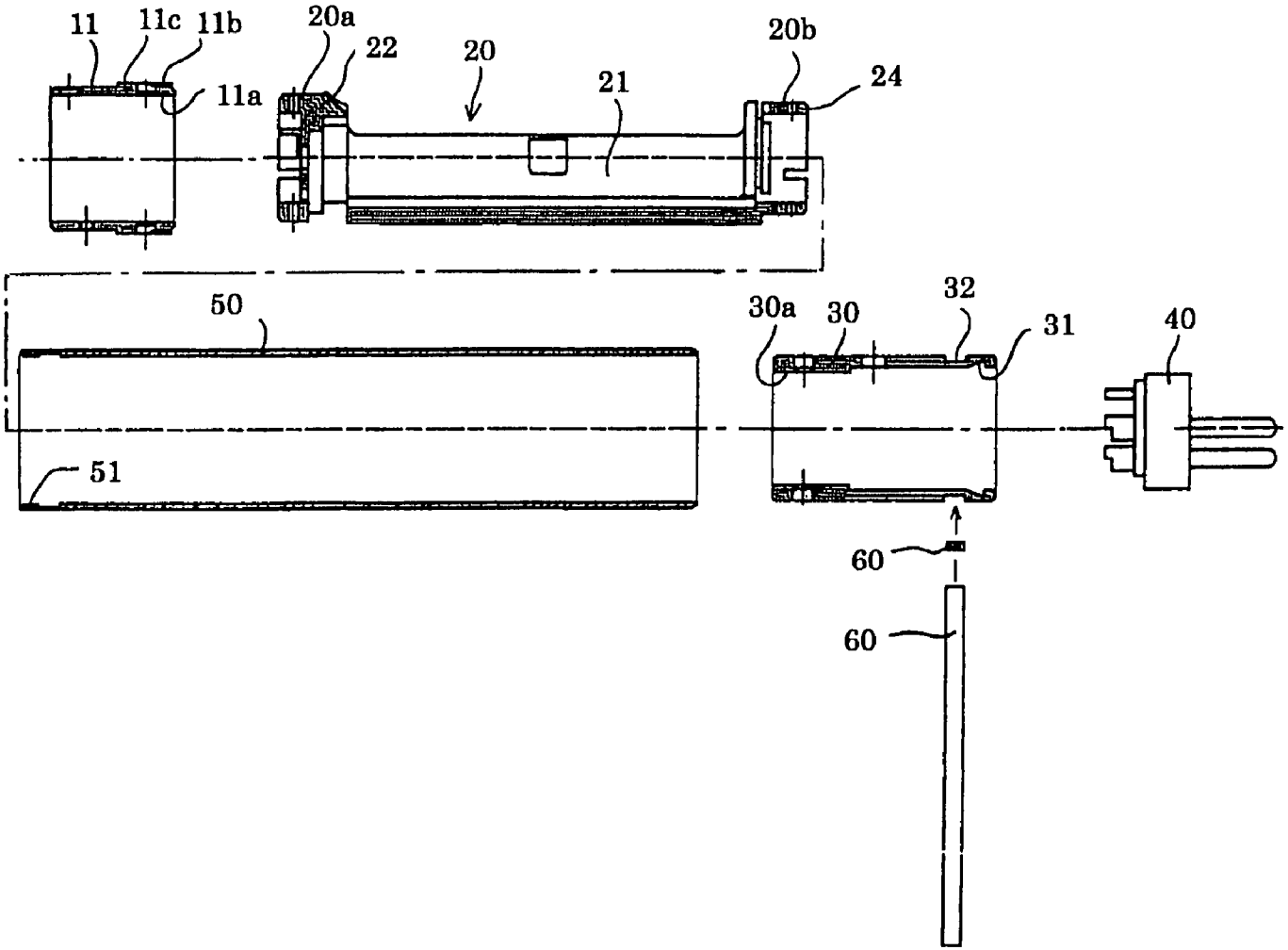
FIG. 1 is an exploded vertical cross section of a capacitor microphone according to an embodiment of the invention.
Figure 2:
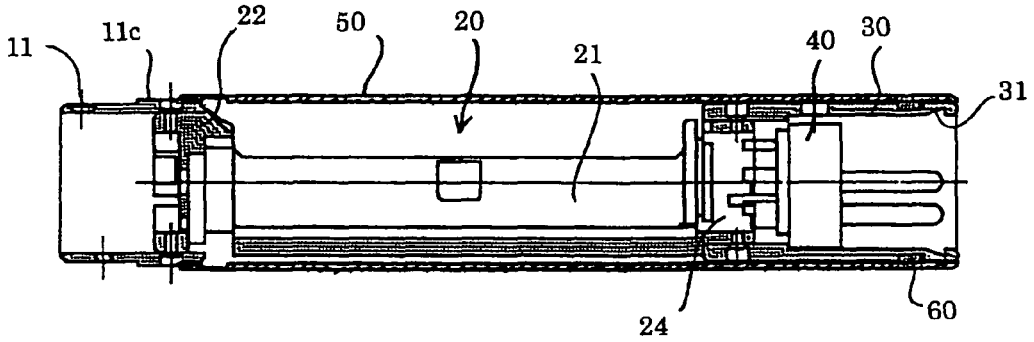
FIG. 2 is a vertical cross section of the capacitor microphone of FIG. 1.
Figure 3:
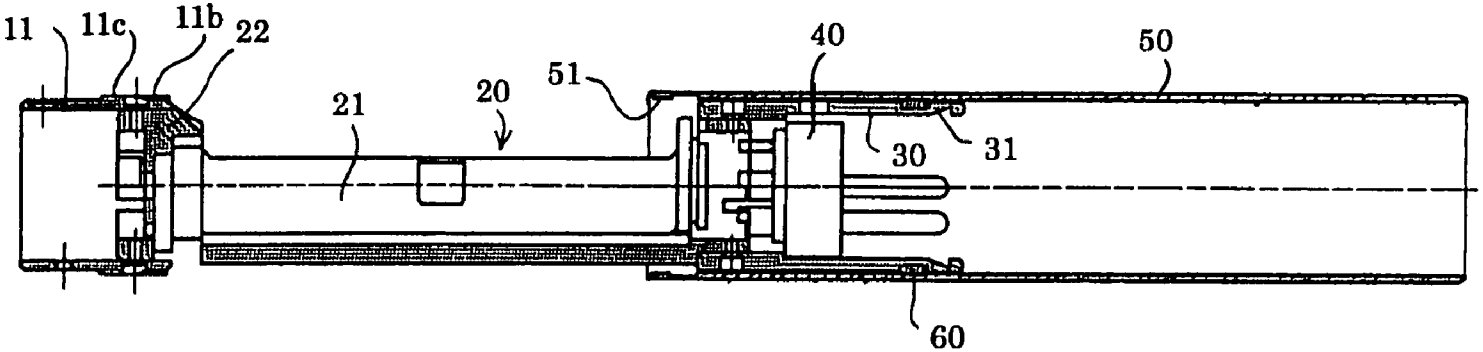
FIG. 3 is a vertical cross section showing the state in which a battery holder is opened.
Figure 4:
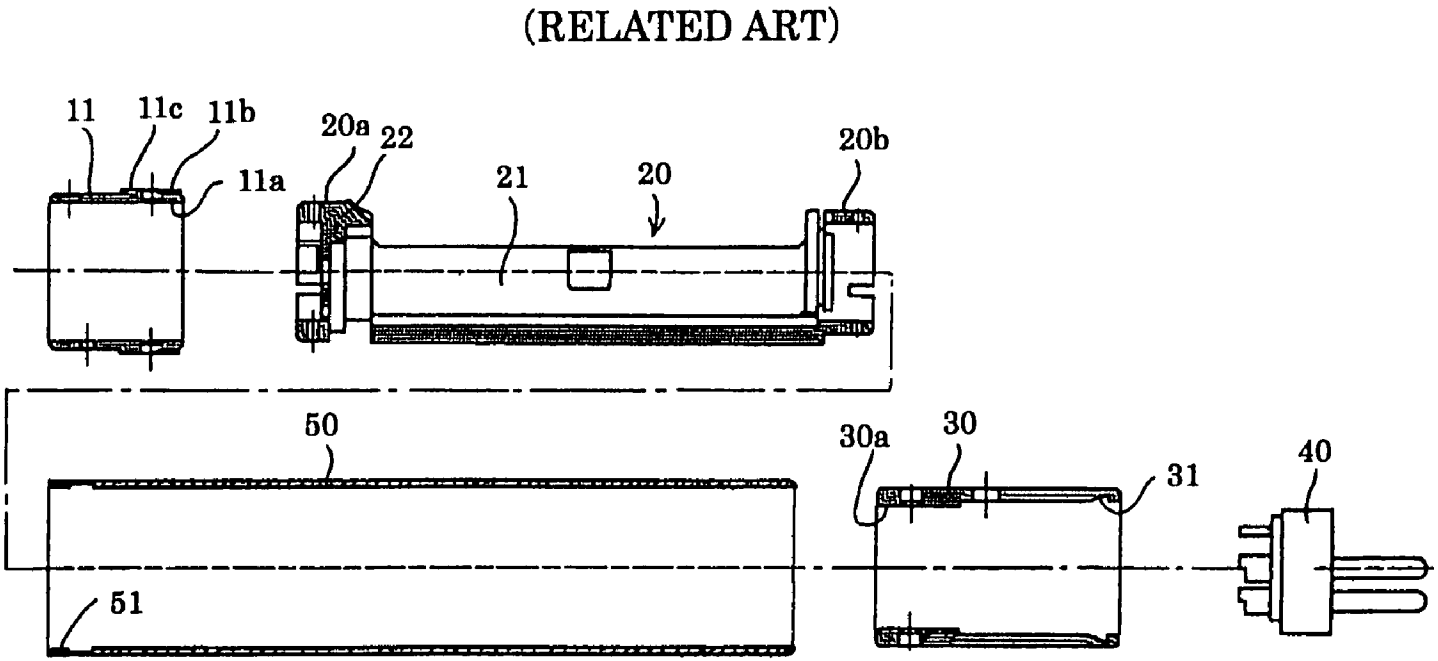
FIG. 4 is an exploded vertical cross section of a capacitor microphone of the related art.
Figure 5:
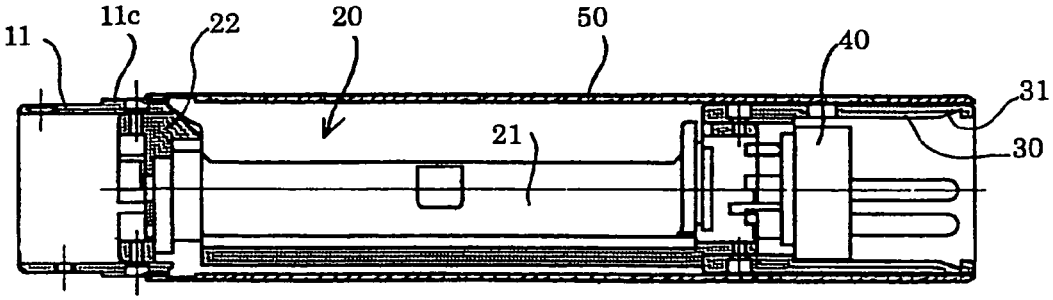
Fig. 5 (RELATED ART)
FIG. 5 is a vertical cross section of the capacitor microphone of FIG. 4.
Figure 6:
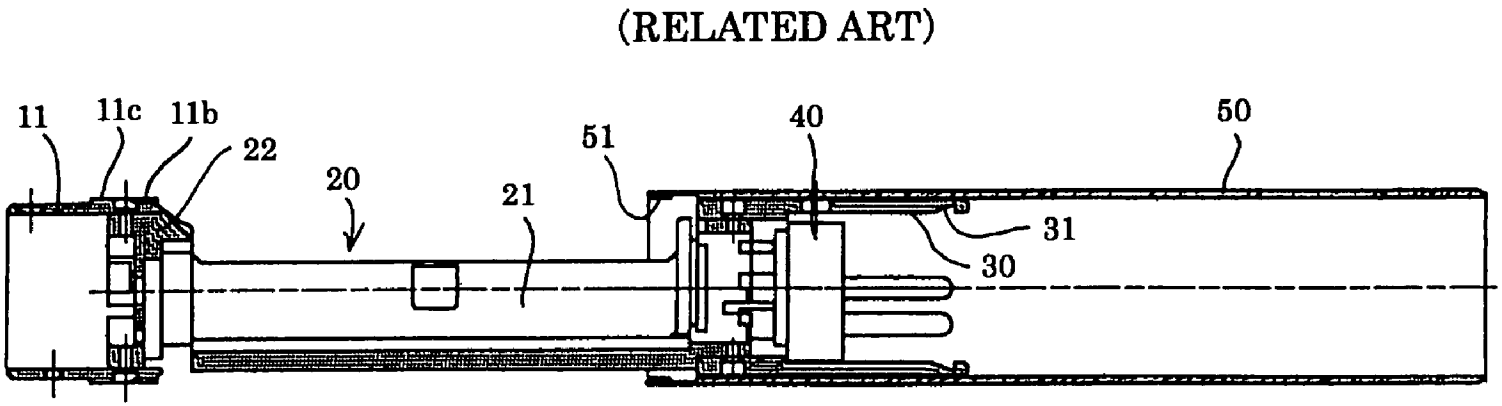
FIG. 6 is a vertical cross section showing the state in which a battery holder is opened.

Referring to FIG. 1 to FIG. 3, a cylindrical coupler 11 has a female screw 11*a* and male screws 11*b* and 11*c* in its rear end (shown at the light end). The male screws 11*b* and 11*c* are adjacent to each other. The coupler 11 is fitted into a microphone unit housing (not shown) from its front end. Specifically, the coupler 11 is coupled to the microphone unit housing when the male screw 11*c* is engaged with a female screw of the microphone unit housing. The microphone unit housing houses a capacitor microphone unit. In order to block electromagnetic waves, the microphone unit housing and the coupler 11 are made of conductive materials such as an aluminum or a brass alloy, and are electrically connected each other. In this embodiment, the microphone unit housing and the coupler 11 are independent, but are combined. Alternatively, they may be structured as one unit. For instance, the coupler 11 may function also as the microphone unit housing.

A battery holder 20 is joined to the rear end of the coupler 11 with a male screw 20*a* of the battery holder 20 engaged with the female screw 11*a* of the coupler 11. The male screw 20*a* is around the outer surface of the battery holder 20. The battery holder 20 has a battery recess 21 in the shape of a ship bottom in order to house a size AA battery, for instance. Cylindrical joints 22 and 24 are provided at front and rear ends of the battery holder 20 as integral parts. The male screw 20*a* is present around the cylindrical joint 22 while a male screw 20*b* is present around the cylindrical joint 24. Positive and negative contacts (not shown) are provided at the front and rear ends of the battery recess 21, and are connected to positive and negative poles of the battery. Necessary wirings are connected to the positive and negative contacts. The battery holder 20 except for electrode terminals and the cylindrical joints 22 and 24 may be made of synthetic resins, for example.

A conductive connector sleeve 30 has a female screw 30*a* on its inner surface. The female screw 30*a* is fitted into the male screw 20 of the battery holder 20, so that the battery holder 20 and the conductive connector sleeve 30 are coupled. An output connector 40 is inserted into the connector sleeve 30, and is fixed using a set screw (not shown) which radially passes through the connector sleeve 30. The connector sleeve 30 has a claw-shaped groove 31 on its rear inner surface. The output connector 40 is housed in the connector sleeve 30.

The output connector 40 is preferably a 3-pin type output connector according to the EIAJ RC-5236, "Latch type Round Connector for Acoustic Devices". No. 1 pin is a grounding pin, and is electrically connected to the connector sleeve 30 via a screw (not shown). The output connector 40 is detachably attached to a plug at one end of a balanced shield cable. The plug is provided with a grounding sleeve at a part where it is fitted into the connector sleeve 30. The grounding sleeve is connected to a shielded wire of the shielded cable. The grounding sleeve and the output sleeve 30 become conductive.

The grounding sleeve has a locking claw at a part thereof, which is fitted in a groove 31 on the connector sleeve 30. The locking claw is disengaged from the groove 31 by operating a knob or the like, which enables the output connector 40 and the plug of the balanced shield cable to be disengaged from each other. A disengaging structure is well-known and is not shown in the drawings.

Referring to FIG. 2 and FIG. 3, a cylindrical battery cover 50 extends over the output connector 40 and the battery holder 20, and is attached to the coupler 11 by fitting a female screw 51 on an inner front end of the battery cover 50 into the male screw 11*b* of the coupler 11. When fitted into the coupler 11, the battery cover 50 is long enough to cover the battery holder 20 and the connector sleeve 30. The battery holder 20 can be opened by disengaging the coupler 11 and moving the battery cover 50 rearward. In this state, the battery can be replaced. Thereafter, the battery cover 50 is again attached and fitted into the coupler 11.

The battery cover 50 is required to block high frequency electromagnetic waves which enter into the microphone via the output connector 40 and the battery holder 20. For this purpose, the battery cover 50 has to be not only electrically and mechanically coupled to the microphone unit housing at the position where the battery cover 50 extends over the battery holder 20, but also be electrically connected to the connector sleeve 30. In the applicant's prior application, the battery cover and the connector sleeve are electrically in point contact with each other, so that the battery cover cannot sufficiently block high frequency electromagnetic waves. In the embodiment shown in FIG. 1 to FIG. 3, the battery cover 50 is devised to effectively block electromagnetic waves. This is the important feature of the present invention as described hereinafter.

Referring to FIG. 1 to FIG. 3, the connector sleeve 30 has a groove 32 on its peripheral surface. The groove 32 has a rectangular cross section, and houses an elastic and conductive cloth 60 therein. The elastic and conductive cloth 60 is made of woven stainless threads, or a strip of non-woven cloth, has a certain thickness, and is elastic. The elastic and conductive cloth 60 may be a conductive cloth SUI-78-5010T manufactured by Taiyo Metal Wire Cloth, Co., Ltd. The elastic and conductive cloth 60 extends substantially wholly in the groove 32. The thickness of the elastic and conductive cloth 60 is larger than the depth of the groove 32, so that the elastic and conductive cloth 60 sticks out of the groove 32. The elastic and conductive cloth 60 has its one surface applied an adhesive, and is then put into the groove 32. This is effective in preventing the cloth 60 from coming out of the groove 32. For this purpose, the adhesive should be conductive.

Referring to FIG. 2 and FIG. 3, the battery cover 50 is attached around the outer surface of the connector sleeve 30, and radially pushes the sticking out edge of the elastic and conductive cloth 60, which is elastically compressed, and is in pressure contact with the inner surface of the battery cover 50. It seems as if the elastic and conductive cloth 60 is in surface contact with the battery case 50. Strictly speaking, the elastic and conductive cloth 60 which is made of the conductive thin threads or non-woven conductive cloth is contacted with the circular battery case 50, so that they are in close contact with each other at myriad of points or lines.

The connector sleeve 30 and the battery cover 50 are conductive via the elastic and conductive cloth 60. When loading or replacing the battery in the battery holder 20, the female screw 51 of the battery holder 50 and the male screw 11*b* of the coupler 11 are disengaged, the battery cover 50 is moved backward as shown in FIG. 2, and the battery recess 21 is opened. When moving the battery cover 50, the inner surface of the battery cover 50 rubs against the outer surface of the elastic and conductive cloth 60, which has a small frictional force. Further, since the elastic and conductive cloth 60 is fitted in the groove 32 of the connector sleeve 30, a movable distance of the battery cover 50 is restricted. Therefore, the battery cover 50 is easily slidable on the elastic and conductive cloth 60 which stays at its predetermined position.

After loading or replacing the battery, the battery cover 50 is made to slide and cover the battery holder 20. Then, the female screw 51 is fitted into the male screw 11*b*, so that the battery holder 20 is fixedly attached. In this state, the battery cover 50 is conductively coupled to the connector sleeve 30 via the elastic and conductive cloth 60. Further, battery cover 50 is conductively coupled to the microphone unit housing via the coupler 11. When the plug of the balanced and shield cable is attached to the output connector 40, the output connector 40 is electrically connected to the shielded wire. Therefore, the shielded wire, connector sleeve 30 and battery cover 50 become conductive, which enables the battery cover 50 to block high frequency electromagnetic waves.

The conductive cloth 60 is in contact with the connector sleeve 30 at a myriad of points or lines, i.e., substantially in surface contact with the connector sleeve 30, so that the connector sleeve 30 and the battery cover 50 are conductive with each other. This is effective in blocking high frequency electromagnetic waves. Further, the conductive cloth 60 extends around the whole periphery of the connector sleeve 30, which is effective in blocking high frequency electromagnetic waves. Especially, even if cellular phones or the like are used adjacent to the capacitor microphone, electromagnetic waves are prevented from entering into the microphone unit via the connectors or the battery holder 20. As a result, noises are prevented from being generated due to high frequency electromagnetic waves.

The conductive cloth 60 in a compressed state is fitted between the battery cover 50 and the connector sleeve 30, so that they are in pressure contact with each other. This is effective in preventing the battery cover 50 and the connector sleeve from becoming loose.

In the foregoing embodiment, the conductive adhesive is applied at one point of the conductive cloth 60 along the length thereof. Alternatively, the adhesive may be applied to two or more positions.

The present invention is applicable to any types of capacitor microphones. For instance, the microphone may operate on the electric power only from the battery, from the battery and an external power source, and so on.

What is claimed is:

1. A capacitor microphone comprising:

a battery holder which is connected to a microphone unit housing at one end and is connected to a connector sleeve at the other end, the other end of the battery holder being circumferentially surrounded by the connector sleeve;

an output connector housed in the connector sleeve, and detachably receiving a plug having a grounding sleeve for a microphone cable;

a cylindrical conductive battery cover which is slidably movable in a direction along an axis of a longitudinal extension of the battery holder, between a position covering the battery holder and a position releasing the battery holder and is electrically connected to the microphone unit housing at the position covering the battery holder; and an elastic and conductive cloth which is present between the connector sleeve and the cylindrical conductive battery cover, and is in contact with the connector sleeve and the cylindrical conductive battery cover, the connector sleeve and the battery cover being electrically connected by the elastic and conductive cloth, the elastic and conductive cloth arranged such that during the slidable movement of the cylindrical conductive battery cover the electrical connection is maintained, wherein the elastic and conductive cloth is fitted into a groove on a peripheral surface of the connector sleeve, and is in contact with an inner surface of the battery cover.

2. The capacitor microphone of claim 1, wherein the elastic and conductive cloth is in the shape of a strip, and is wound around the connector sleeve.

3. The capacitor microphone of claim 1, wherein the microphone unit housing is housed in a cylindrical coupler into which one end of the battery cover is screwed, the coupler and the battery cover being electrically and mechanically coupled.

4. The capacitor microphone of claim 3, wherein a battery holder has one end thereof screwed into the coupler and the other end thereof screwed into the connector sleeve, and the coupler, battery holder and connector sleeve are mechanically made one unit.

5. The capacitor microphone of claim 1, wherein the elastic and conductive cloth is fitted into a groove on a peripheral surface of the connector sleeve, the groove and the elastic and conductive cloth surrounding a whole circumference of the peripheral surface of the connector sleeve.

6. The capacitor microphone of claim 5, wherein the elastic and conductive cloth has a thickness that is larger than a depth of the groove.

* * * * *